US010108123B2

(12) United States Patent
Ito et al.

(10) Patent No.: US 10,108,123 B2
(45) Date of Patent: Oct. 23, 2018

(54) IMAGE FORMING APPARATUS

(71) Applicant: CANON KABUSHIKI KAISHA, Tokyo (JP)

(72) Inventors: Motonari Ito, Suntou-gun (JP); Kuniaki Tamagaki, Kawasaki (JP); Makoto Tokudome, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/713,433

(22) Filed: Sep. 22, 2017

(65) Prior Publication Data

US 2018/0088507 A1 Mar. 29, 2018

(30) Foreign Application Priority Data

Sep. 29, 2016 (JP) ..... 2016-191195

(51) Int. Cl.
*G03G 15/00* (2006.01)
*G03G 15/08* (2006.01)
(Continued)

(52) U.S. Cl.
CPC ..... *G03G 15/5045* (2013.01); *G03G 15/0815* (2013.01); *G03G 21/0094* (2013.01);
(Continued)

(58) Field of Classification Search
CPC ..... G03G 15/0808; G03G 15/0813; G03G 15/0815; G03G 15/0896; G03G 15/2035; G03G 15/2039; G03G 15/205; G03G 15/2078; G03G 15/5008; G03G 15/5012; G03G 15/5033; G03G 15/5045; G03G 15/75; G03G 15/751; G03G 21/0005; G03G 21/0064; G03G 21/1619; G03G 21/1676; G03G 21/1821; G03G 21/1825; G03G 21/203; G03G 2215/00071;
(Continued)

(56) References Cited

U.S. PATENT DOCUMENTS

2003/0035659 A1* 2/2003 Uchiyama ..... G03G 15/2003 399/69
2006/0159479 A1* 7/2006 Sugita ..... G03G 15/2025 399/69

FOREIGN PATENT DOCUMENTS

JP 2-93565 A 4/1990
JP 6-41257 Y2 10/1994
(Continued)

*Primary Examiner* — Joseph S Wong
(74) *Attorney, Agent, or Firm* — Canon USA, Inc. I.P. Division

(57) ABSTRACT

An image forming apparatus includes an image bearing member, a developer bearing member, a fixing unit including a heating member, a rotary member which is heated by the heating member, and a nip area where the rotary member comes into contact with a sheet, and configured to perform fixing by heating a developer image transferred to the sheet and fixing the developer image to the sheet in the nip area, and a control unit configured to execute, while the fixing is not performed, a mode in which the image bearing member is rotated with the developer bearing member being in a separated position and the heating member is controlled such that a temperature of a portion of a surface of the rotary member, after the rotary member passes through the nip area, is maintained higher than the temperature of the portion during the fixing.

26 Claims, 9 Drawing Sheets

(51) Int. Cl.

| | |
|---|---|
| ***G03G 15/20*** | (2006.01) |
| ***G03G 21/00*** | (2006.01) |
| ***G03G 21/16*** | (2006.01) |
| ***G03G 21/18*** | (2006.01) |
| ***G03G 21/20*** | (2006.01) |

(52) U.S. Cl.

CPC ..... *G03G 21/203* (2013.01); *G03G 15/0808* (2013.01); *G03G 15/0813* (2013.01); *G03G 15/0896* (2013.01); *G03G 15/205* (2013.01); *G03G 15/2035* (2013.01); *G03G 15/2039* (2013.01); *G03G 15/2078* (2013.01); *G03G 15/5008* (2013.01); *G03G 15/5012* (2013.01); *G03G 15/5033* (2013.01); *G03G 15/75* (2013.01); *G03G 15/751* (2013.01); *G03G 21/0005* (2013.01); *G03G 21/0064* (2013.01); *G03G 21/1619* (2013.01); *G03G 21/1676* (2013.01); *G03G 21/1821* (2013.01); *G03G 21/1825* (2013.01); *G03G 2215/00071* (2013.01); *G03G 2215/00075* (2013.01); *G03G 2215/0872* (2013.01); *G03G 2221/0026* (2013.01); *G03G 2221/0036* (2013.01); *G03G 2221/0089* (2013.01); *G03G 2221/1609* (2013.01)

(58) Field of Classification Search

CPC . G03G 2215/00075; G03G 2215/0872; G03G 2221/0026; G03G 2221/0036; G03G 2221/0089; G03G 2221/1609; G03G 2221/1687; G03G 2221/1861; G03G 2221/1884

See application file for complete search history.

(56) References Cited

FOREIGN PATENT DOCUMENTS

| | | | |
|---|---|---|---|
| JP | 11-202654 | A | 7/1999 |
| JP | 2000-267550 | A | 9/2000 |
| JP | 2001-222205 | A | 8/2001 |
| JP | 2001-265115 | A | 9/2001 |
| JP | 2004-13015 | A | 1/2004 |
| JP | 2004-109164 | A | 4/2004 |
| JP | 2004-325642 | A | 11/2004 |
| JP | 2008-170567 | A | 7/2008 |
| JP | 2008-299137 | A | 12/2008 |

* cited by examiner

IMAGE FORMING APPARATUS

BACKGROUND OF THE INVENTION

Field of the Disclosure

The present disclosure generally relates to electrophotographic image forming apparatuses such as copying machines, printers (light emitting diode (LED) printers, laser beam printers, etc.), facsimile apparatuses, and word processors.

Description of the Related Art

There have been cases in which condensation occurs on the surface of a photosensitive drum which is an electrostatic latent image bearing member in an electrophotographic image recording apparatus, such as a printer or a copying machine, in a high-temperature, high-humidity environment. It is known that the occurrence of condensation on the surface of a photosensitive drum causes charges of an electrostatic latent image on the surface of the photosensitive drum to move to cause a defect in image quality which is called image smearing.

Japanese Patent Application Laid-Open No. 2004-325642 discusses a method of removing condensation by heating the surface of a photosensitive drum using a fixing unit as a heat generation unit.

In an image forming apparatus that employs a so-called contact development method in which a development process is performed with an image bearing member (photosensitive drum) and a developer bearing member being in contact with each other, when the surface of the image bearing member is heated by heat from a fixing unit to remove condensation, the following problems can occur.

Specifically, when the image bearing member is heated with the developer bearing member being in contact with the image bearing member, the heat is transferred from the image bearing member to the developer bearing member, and this increases the time needed to increase the temperature of the surface of the image bearing member. Thus, the time (downtime) during which an image forming process cannot be performed may need to be set longer.

Further, the image bearing member is rotated for a longer time during the process of heating the image bearing member, so the surface of the image bearing member is rubbed for a longer time and abraded by a member which is in contact with the image bearing member, and this can accelerate deterioration of the image bearing member. Similarly, the surface of the developer bearing member is also abraded to result in accelerated deterioration of the developer bearing member.

Further, the heat transferred from the image bearing member can damage the developer borne on the developer bearing member or the developer stored in a development tank which stores the developer to be supplied to the developer bearing member, and this can accelerate deterioration. This can increase the possibility of occurrence of image defects such as fog and the like.

SUMMARY OF THE INVENTION

The present disclosure is directed to an advanced technology developed from conventional techniques. Specifically, the present disclosure is directed to a technique for removing condensation while preventing an increase in downtime and/or deterioration in an image bearing member, a developer bearing member, or a developer in the arrangement in which the developer bearing member is brought into contact with the image bearing member to supply a developer to the surface of the image bearing member.

According to an aspect of the present disclosure, an image forming apparatus includes an image bearing member configured to be rotatable and bear a developer image, a developer bearing member configured to be rotatable, bear a developer, and supply the developer to a surface of the image bearing member to form a developer image, a switching unit configured to move the developer bearing member between a contact position in which the developer bearing member is in contact with the image bearing member, and a separated position in which the developer bearing member is separated from the image bearing member, and a fixing unit including a heating member, a rotary member which is heated by the heating member, and a nip area where the rotary member comes into contact with a sheet, and configured to perform fixing by heating the developer image transferred to the sheet and fixing the developer image to the sheet in the nip area, wherein when the developer bearing member is in the separated position, a rotation shaft of the image bearing member is located closer to the fixing unit than a rotation shaft of the developer bearing member, the image forming apparatus further comprising a control unit configured to execute, while the fixing is not performed, a mode in which the image bearing member is rotated with the developer bearing member being in the separated position and the heating member being controlled such that a temperature of a portion of a surface of the rotary member, after the rotary member passes through the nip area, is maintained higher than the temperature of the portion during the fixing.

Further features of the present disclosure will become apparent from the following description of exemplary embodiments with reference to the attached drawings.

DESCRIPTION OF THE EMBODIMENTS

Figure 1:
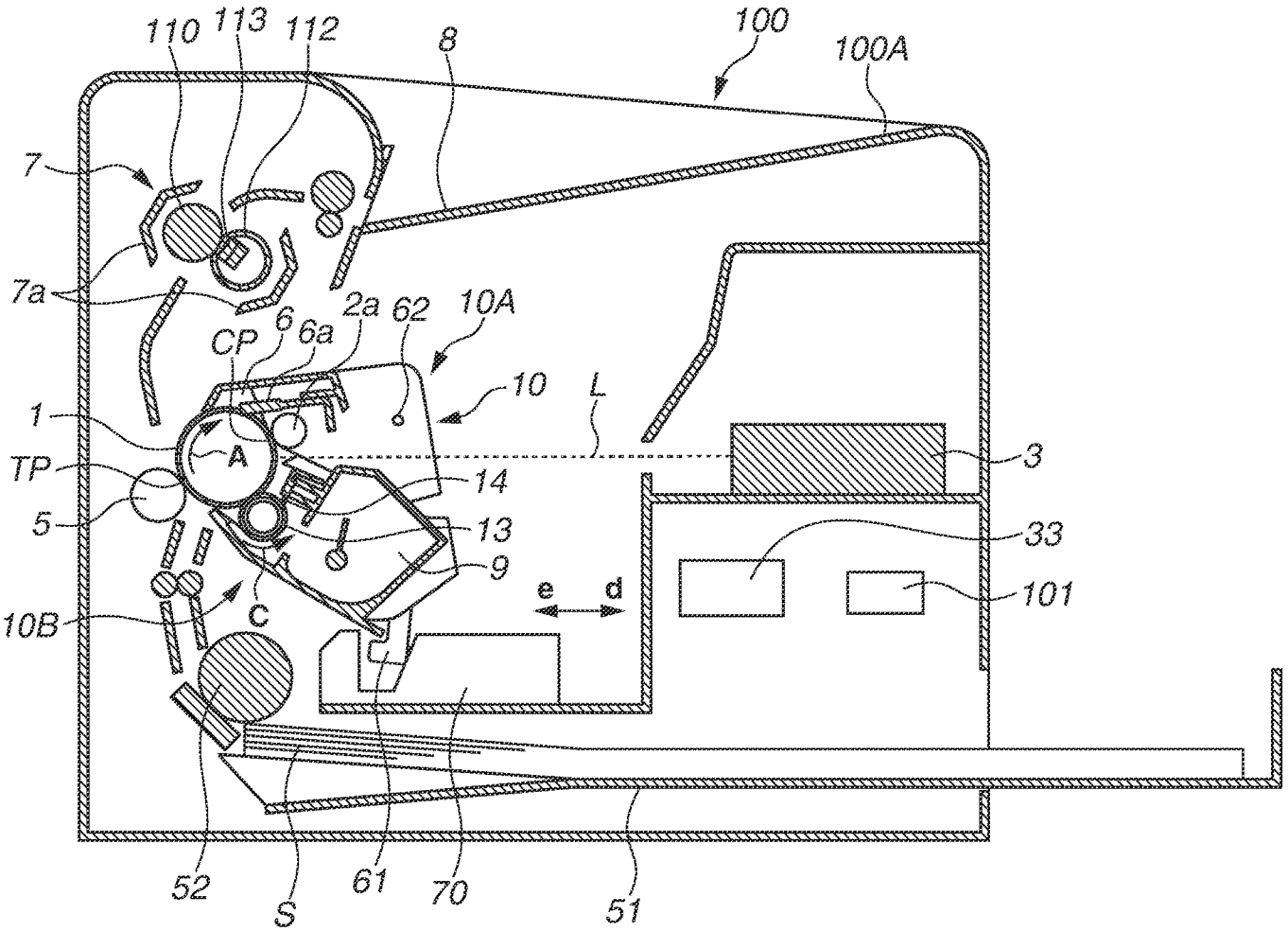
FIG. 1 is a cross-sectional view schematically illustrating an image forming apparatus.

An image forming apparatus according to an exemplary embodiment of the present disclosure will be described in detail below with reference to the drawings. It should be noted that exemplary embodiments described below are mere illustrations of the present disclosure and, unless otherwise specified, the sizes, materials, shapes, and relative positions of components described below are not intended to limit the scope of the disclosure.

<Configuration of Image Forming Apparatus 100 and Image Forming Process>

First, the configuration of an image forming apparatus and an image forming process according to a first exemplar embodiment will be described below with reference to FIG. 1, which is a cross-sectional view schematically illustrating an image forming apparatus 100.

The image forming apparatus 100 mainly includes an apparatus body 100A and a cartridge 10, which is removably attached to the apparatus body 100A. The cartridge 10 mainly includes a drum unit 10A and a development unit 10B, which is supported by the drum unit 10A such that the development unit 10B is rotatable about a shaft portion 62. The drum unit 10A mainly includes a photosensitive drum 1, a charging roller 2, and a cleaning unit 6. The development unit 10B mainly includes a development sleeve 13, a development blade 14, and a storage area 9. The apparatus body 100A mainly includes a sheet cassette 51, a laser scanner 3, a transfer roller 5, a fixing unit 7, and a control unit 33. The control unit 33 is a control circuit unit including a computation unit, such as a central processing unit (CPU), which may include one or more processors and one or more memories, and a non-volatile memory.

Figure 3:
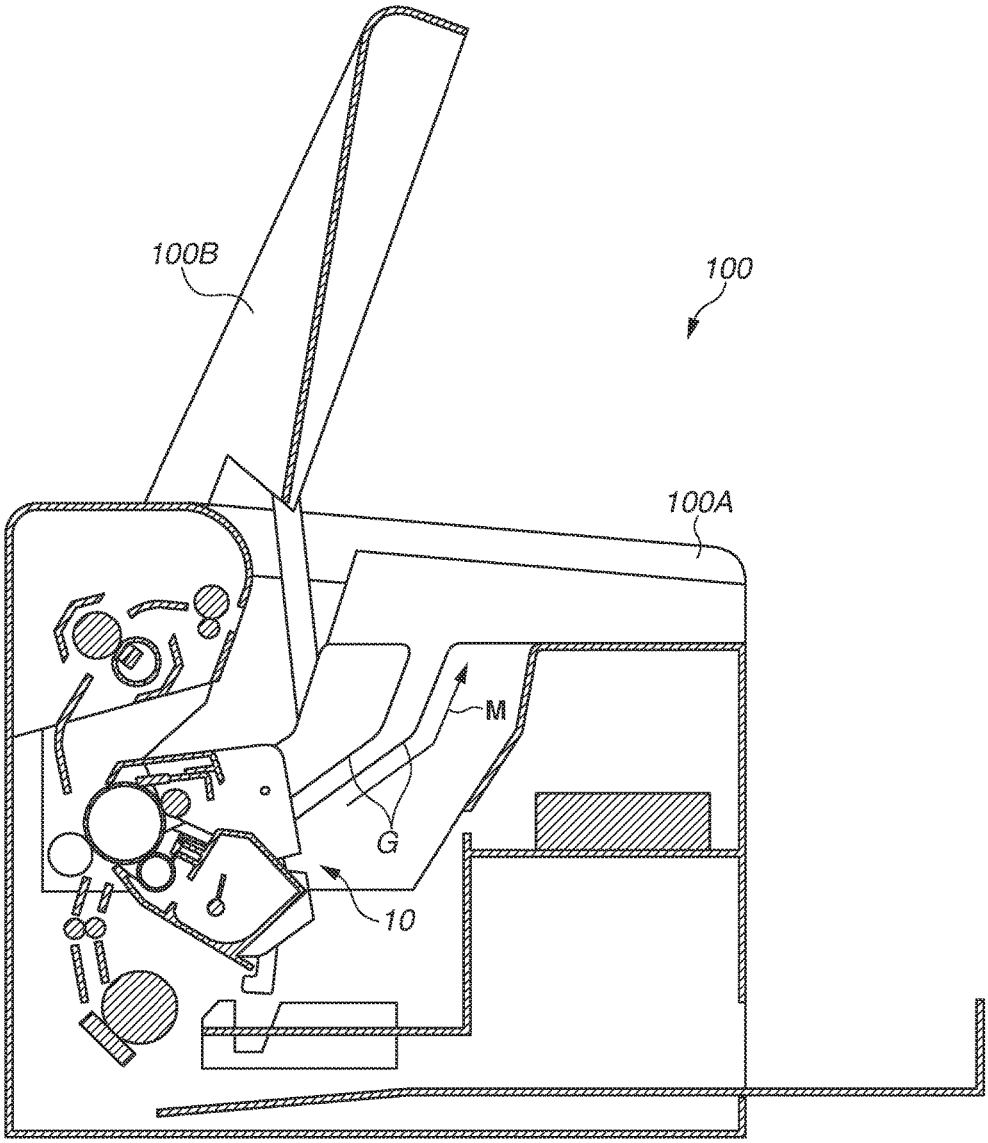
FIG. 3 is a cross-sectional view schematically illustrating an image forming apparatus.

As illustrated in FIG. 3, which is a cross-sectional view schematically illustrating the image forming apparatus 100, when a door 100B is opened with respect to the apparatus body 100A, the cartridge 10 can be moved in the direction of an arrow M and removed from the apparatus body 100A. The apparatus body 100A includes a guide portion G, which determines a path through which the cartridge 10 is moved in the apparatus body 100A.

Next, the image forming process will be described below. If the control unit 33 receives a signal containing an image forming instruction and image information from a host computer (not illustrated), etc., the control unit 33 performs control to execute the following process.

First, a sheet S stored in the sheet cassette 51 is conveyed by a conveyance roller 52, and the photosensitive drum 1, which is an image bearing member, is driven and rotated in synchronization with the conveyance of the sheet S. The sheet S is a recording medium such as a sheet or film.

The photosensitive drum 1, which is the image bearing member, includes on its surface an organic photoconductive (OPC) layer of negative polarity, having a diameter of 24 mm. The photosensitive drum 1 is driven and rotated in the direction of an arrow A at a constant peripheral speed of 100 mm/sec (=process speed PS, printing speed).

Next, the surface of the photosensitive drum 1 is charged by the charging roller 2 (charging). The charging roller 2, which is a charging member, is brought into contact with the surface of the photosensitive drum 1 in a charging position CP and is rotated by the photosensitive drum 1. The charging roller 2 is a conductive elastic roller including a metal core coated with a conductive elastic layer. The charging roller 2 is pressed against the photosensitive drum 1 by a predetermined pressing force. A charging power source (not illustrated) configured to apply a charging bias to the charging roller 2 applies a direct current voltage to the metal core. The applied direct current voltage is set to a value such that the potential difference between the surface of the photosensitive drum 1 and the charging roller 2 is equal to or greater than a discharge start voltage. Specifically, a direct current voltage of −1300 V is applied as the charging bias. The application of such a charging bias charges the surface of the photosensitive drum 1 to a charging potential (dark area potential) of −700 V in the charging position (charging region) CP.

Next, the charged surface of the photosensitive drum 1 is exposed by the laser scanner 3 (exposing). The laser scanner 3, which is an exposure unit, outputs laser light L based on the image information and scans the surface of the photosensitive drum 1 to perform exposing. In this way, an electrostatic latent image corresponding to the image information is formed on the surface of the photosensitive drum 1. The power of the laser light L is set such that the exposed portion of the surface of the photosensitive drum 1 has a potential of −150 V.

Next, the development unit 10B supplies a developer to the surface of the photosensitive drum 1 on which the electrostatic latent image is formed, whereby a developer image is formed (developing). The development unit 10B contains in the storage area 9 thereof a magnetized mono component toner of negative polarity as the developer. The development sleeve 13, which is a developer bearing member, includes an aluminum tube and a rubber layer provided on the aluminum tube. The aluminum tube has an outer diameter of 12 mm and an inner diameter of 9 mm, and the rubber layer has a thickness of 1 mm. The development sleeve 13 is driven and rotated in the direction of an arrow C. The toner is attracted to the development sleeve 13 and borne by the magnetic force of a magnet (not illustrated) which is a magnetic field generation member included in the development sleeve 13. The toner borne on the development sleeve 13 is friction-charged to have negative polarity while the thickness of the toner is controlled to a predetermined layer thickness by the development blade 14. A force reception portion 61 of the development unit 10B is pressed in the direction of an arrow e by a pressing member 70 provided to the apparatus body 100A so that the development sleeve 13 is brought into contact with the photosensitive drum 1 and is pressed against the photosensitive drum 1. In this state, a development bias application source (not illustrated) applies a development bias between the development sleeve 13 and the photosensitive drum 1. The development bias is set to −350 V. By the developing described above, the toner adheres to the surface of the photosensitive drum 1 in a development position (development region), in which the development sleeve 13 and the photosensitive drum 1 are in contact with each other, according to the electrostatic latent image on the photosensitive drum 1 to visualize the electrostatic latent image with the toner. Specifically, a toner image (developer image) corresponding to the electrostatic latent image is formed on the surface of the photosensitive drum 1.

Next, the toner image formed on the surface of the photosensitive drum 1 is transferred onto the sheet S by the transfer roller 5 (transferring). The transfer roller 5, which is a transfer member, is a roller including a metal core coated with an intermediate-resistance foam layer, and the roller resistance value is $5\times10^8\Omega$. The transfer roller 5 is pressed against the photosensitive drum 1 to form a transfer nip area between the transfer roller 5 and the photosensitive drum 1. The transfer nip area is a transfer region (the transfer position TP) where the toner image is transferred from the photosensitive drum 1 onto the sheet S. A voltage of +2.0 kV is applied to the metal core of the transfer roller 5 by a transfer bias source (not illustrated) to transfer the toner image on the surface of the photosensitive drum 1 to the sheet S which is a transfer receiving member.

The method of transferring a toner image formed on the photosensitive drum 1 to a recording medium S is not limited to the above-described method. Alternatively, for example, a primary transfer bias is applied to a first transfer roller (not illustrated) to transfer the toner image from the photosensitive drum 1 onto an intermediate transfer member (not illustrated), and then a secondary transfer bias is applied to a second transfer roller (not illustrated) to transfer the toner image from the intermediate transfer member onto the recording medium (sheet) S. In this arrangement, the intermediate transfer member is the transfer receiving member onto which the toner image is to be transferred from the photosensitive drum 1.

The residual toner that remains on the surface of the photosensitive drum 1 after the photosensitive drum 1 passes through the transfer position is removed by the cleaning unit 6 (cleaning). The cleaning unit 6 includes a cleaning blade 6*a* including a support member, such as a metal plate, and an elastic member, such as urethane rubber, provided to an edge portion of the support member. An edge portion of the cleaning blade 6*a* is brought into contact with the surface of the photosensitive drum 1 in a so-called counter direction with a predetermined pressing force to scrape the toner from the surface of the photosensitive drum 1.

Next, the transferred toner image on the sheet S is fixed by the fixing unit 7 (fixing). The sheet S having passed through the transfer nip area is conveyed to a fixing nip area of the fixing unit 7. The fixing nip area of the fixing unit 7 is formed by a pressing roller 110, a fixing film 112, and a heater 113, and the fixing is performed by heating and pressing the sheet S in the fixing nip area to fix the toner image to the sheet S. Details of the fixing unit 7 and the fixing will be described below.

Next, the sheet S having passed through the fixing unit 7 is conveyed to a sheet discharging area 8. The above-described process performed under the control by the control unit 33 is the image forming process for forming a toner image (forming an image) on a sheet S.

<Contact and Separation of Development Sleeve 13>

The development sleeve 13 and the photosensitive drum 1 can be switched between a contact state, in which the development sleeve 13 and the photosensitive drum 1 are in contact with each other, and a separated state, in which the development sleeve 13 and the photosensitive drum 1 are separated, in order to prevent the development sleeve 13 and the photosensitive drum 1 from rubbing and abrading each other and also prevent the toner from being transferred from the development sleeve 13 onto the surface of the photosensitive drum 1 when the image forming is not performed. The switch between the contact state, in which the development sleeve 13 and the photosensitive drum 1 are in contact with each other, and the separated state, in which the development sleeve 13 and the photosensitive drum 1 are separated from each other, is performed by moving the force reception portion 61 of the development unit 10B with the pressing member (moving member) 70 of the apparatus body 100A which is a switching unit. The movement of the pressing member 70 is controlled by the control unit 33.

Figure 2:
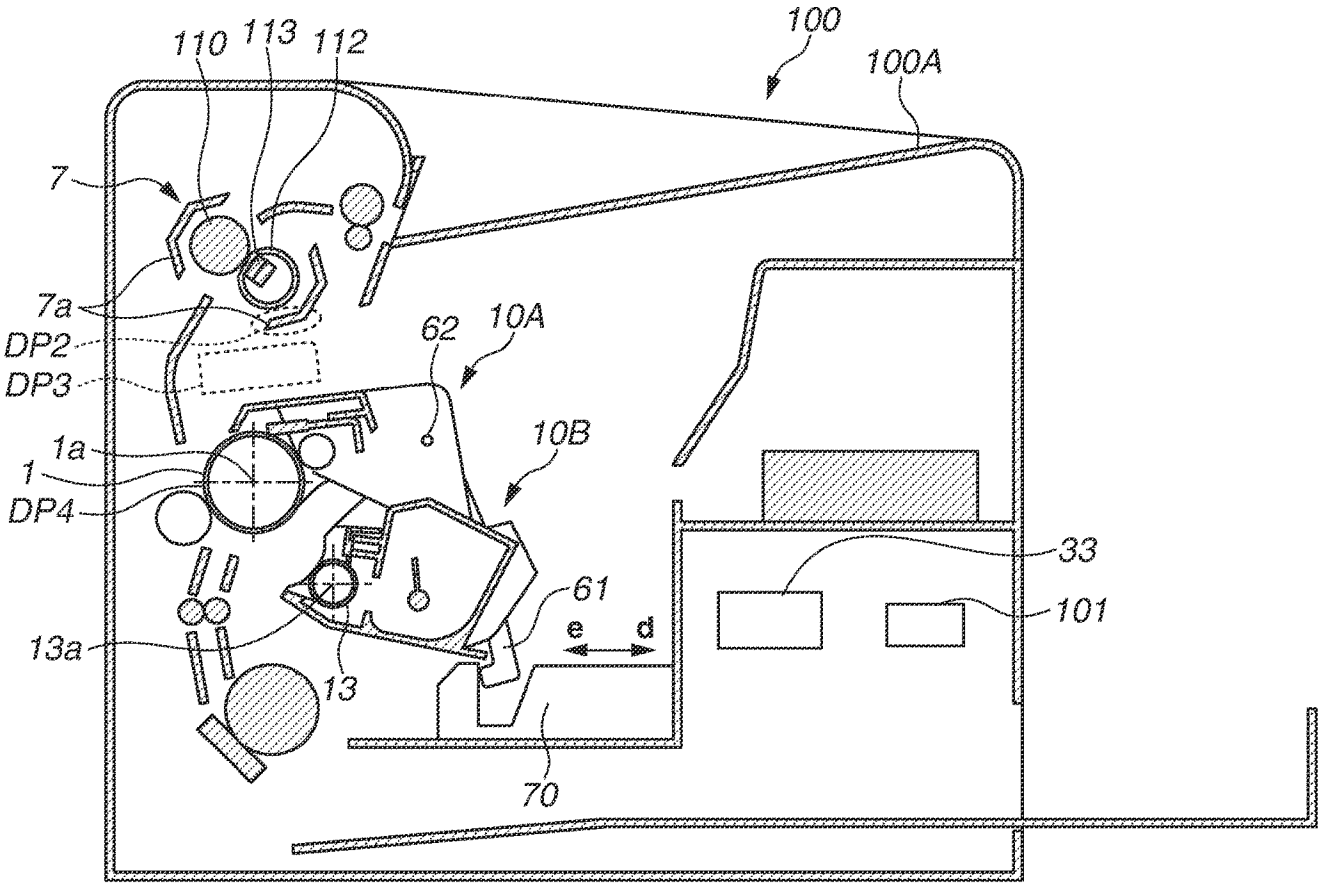
FIG. 2 is a cross-sectional view schematically illustrating an image forming apparatus.

In the state illustrated in FIG. 1, the pressing member 70 presses the force reception portion 61 in the direction of the arrow e so that the development sleeve 13 and the photosensitive drum 1 are in the contact state in which the development sleeve 13 is pressed against the photosensitive drum 1. Specifically, in the state illustrated in FIG. 1, the development sleeve 13 is in the contact state in which the development sleeve 13 is in contact with the photosensitive drum 1. To perform switching from the contact state to the separated state, the pressing member 70 is moved in the direction of an arrow d to press and move the force reception portion 61 in the direction of the arrow d. Specifically, the development unit 10B is rotated with its frame about the shaft portion 62 to move the development sleeve 13 in the direction in which the development sleeve 13 is separated from the photosensitive drum 1. Consequently, the development sleeve 13 and the photosensitive drum 1 are switched to the separated state in which the development sleeve 13 and the photosensitive drum 1 are separated from each other as illustrated in FIG. 2, which is a cross-sectional view schematically illustrating the image forming apparatus 100. Specifically, in the state illustrated in FIG. 2, the development sleeve 13 is in the separated position in which the development sleeve 13 is separated from the photosensitive drum 1.

To perform switching from the separated state illustrated in FIG. 2 to the contact state, the pressing member 70 is moved in the direction of the arrow e to press and move the force reception portion 61 in the direction of the arrow e. In this way, the development unit 10B is rotated with its frame about the shaft portion 62 to move the development sleeve 13 in the direction in which the development sleeve 13 is brought near the photosensitive drum 1. Consequently, the development sleeve 13 and the photosensitive drum 1 are switched to the contact state illustrated in FIG. 1.

While the pressing member 70 is arranged to press the force reception portion 61 in the direction of the arrow e in the contact state or in the direction of the arrow d in the separated state, the arrangement is not limited to the above-described arrangement. Alternatively, for example, a biasing member such as a spring is provided between the development unit 10B and the drum unit 10A. Then, the development sleeve 13 is pressed against the photosensitive drum 1 using the bias of the biasing member without the pressing member 70 pressing the force reception portion 61 in the direction of the arrow e to switch the development sleeve 13 and the photosensitive drum 1 to the contact state, and the pressing member 70 presses the force reception portion 61 in the direction of the arrow d only when switching the development sleeve 13 and the photosensitive drum 1 to the separated state.

The control unit 33 controls the pressing member such that the development sleeve 13 and the photosensitive drum 1 are switched to the contact state at the time of performing the developing during the image forming process, and the development sleeve 13 and the photosensitive drum 1 are switched to the separated state when the developing is ended.

<Structure of Fixing Unit 7>

Figure 4:
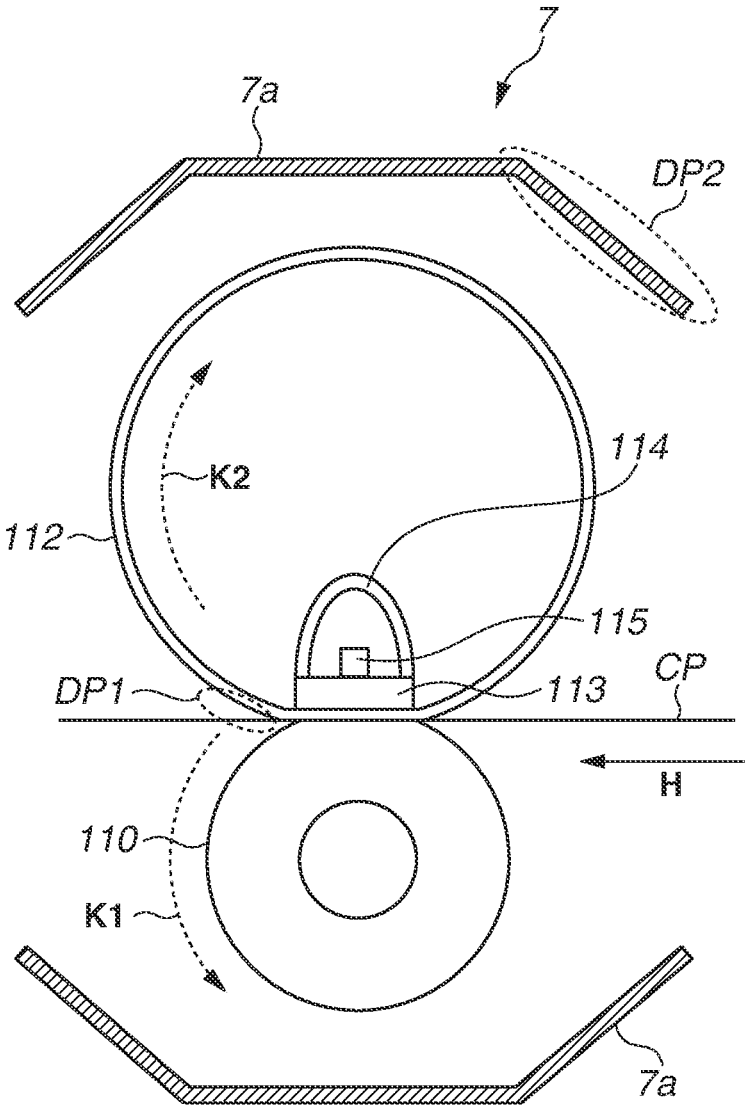
FIG. 4 is a cross-sectional view schematically illustrating a fixing unit.

The fixing unit 7 will be described below with reference to FIG. 4, which is a cross-sectional view schematically illustrating the fixing unit 7. The fixing unit 7 employs a film heating method and uses a film having a small heat capacity as a fixing member which applies heat to the sheet S, so the time needed to increase the temperature of the fixing member to a predetermined temperature is shorter than that in a heat roller method.

The fixing film 112 is a flexible endless belt, and the heater 113, which is a heating member, is provided so as to be in contact with the inner peripheral surface of the fixing film 112. The heater 113 is supported by a pressing stay 114 and is in contact with the inner peripheral surface of the fixing film 112 to heat the fixing film 112 from the inside. The pressing roller 110, which is a pressing member, is situated and pressed against the heater 113 with the fixing film 112 sandwiched between the pressing roller 110 and the heater 113, and a fixing nip area N is formed between the outer peripheral surface of the fixing film 112 and the surface of the pressing roller 110. The pressing roller 110 is driven and rotated in the direction of an arrow K1 by a driving source (not illustrated), and the fixing film 112 is driven by the pressing roller 110, with which the fixing film 112 comes into contact in the fixing nip area N, and rotated in the direction of an arrow K2. A sheet conveyance path R through which the sheet S is conveyed is provided to pass through the fixing nip area N. The fixing film 112, the pressing roller 110, the heater 113, and the pressing stay 114 are supported by a fixing frame 7*a* of the fixing unit 7 which is a frame member, situated to surround the fixing film 112, the pressing roller 110, the heater 113, and the pressing stay 114.

The heat of the heater 113 is transmitted from the inner peripheral surface to the outer peripheral surface of the fixing film 112 and is then transmitted to the surface of the pressing roller 110 in the fixing nip area N. When the sheet S having the transferred toner image is conveyed in the direction of an arrow H by a sheet conveying member (not illustrated) through the sheet conveyance path R to the fixing nip area N, the heat from the fixing film 112 and the pressing roller 110 is transmitted to the toner image and the sheet S to fuse the toner, and the toner image and the sheet S are pressed in the fixing nip area N. Consequently, the toner image is fixed to the sheet S.

A thermistor 115, which is a temperature detection unit, is provided to the back side of a substrate that includes the heater 113. Based on the output of the thermistor 115, a power application control circuit (triac) (not illustrated) performs control to turn on/off the current applied to the heater 113 to adjust the temperature of the heater 113 such that the surface temperature of the fixing film 112 becomes constant. The power application control circuit performs the above-described control based on an instruction from the control unit 33. According to the present exemplary embodiment, the control is performed such that the temperature P of the surface of the fixing film 112 immediately after the surface of the fixing film 112 passes through the fixing nip area N is P1 [degrees Celsius], during the fixing of the toner image to the sheet S in the image forming process. According to the present exemplary embodiment, P1 [degrees Celsius]=150 [degrees Celsius]. The temperature of the ambient atmosphere of the thermistor 115, the heater 113, or the pressing stay 114 at the time when the temperature P of a portion DP1 (FIG. 4) immediately after the fixing film 112 passes through the fixing nip area N is P1 is denoted by P7 [degrees Celsius].

<Condensation Removal Sequence (Condensation Removal Mode)>

Figure 7:
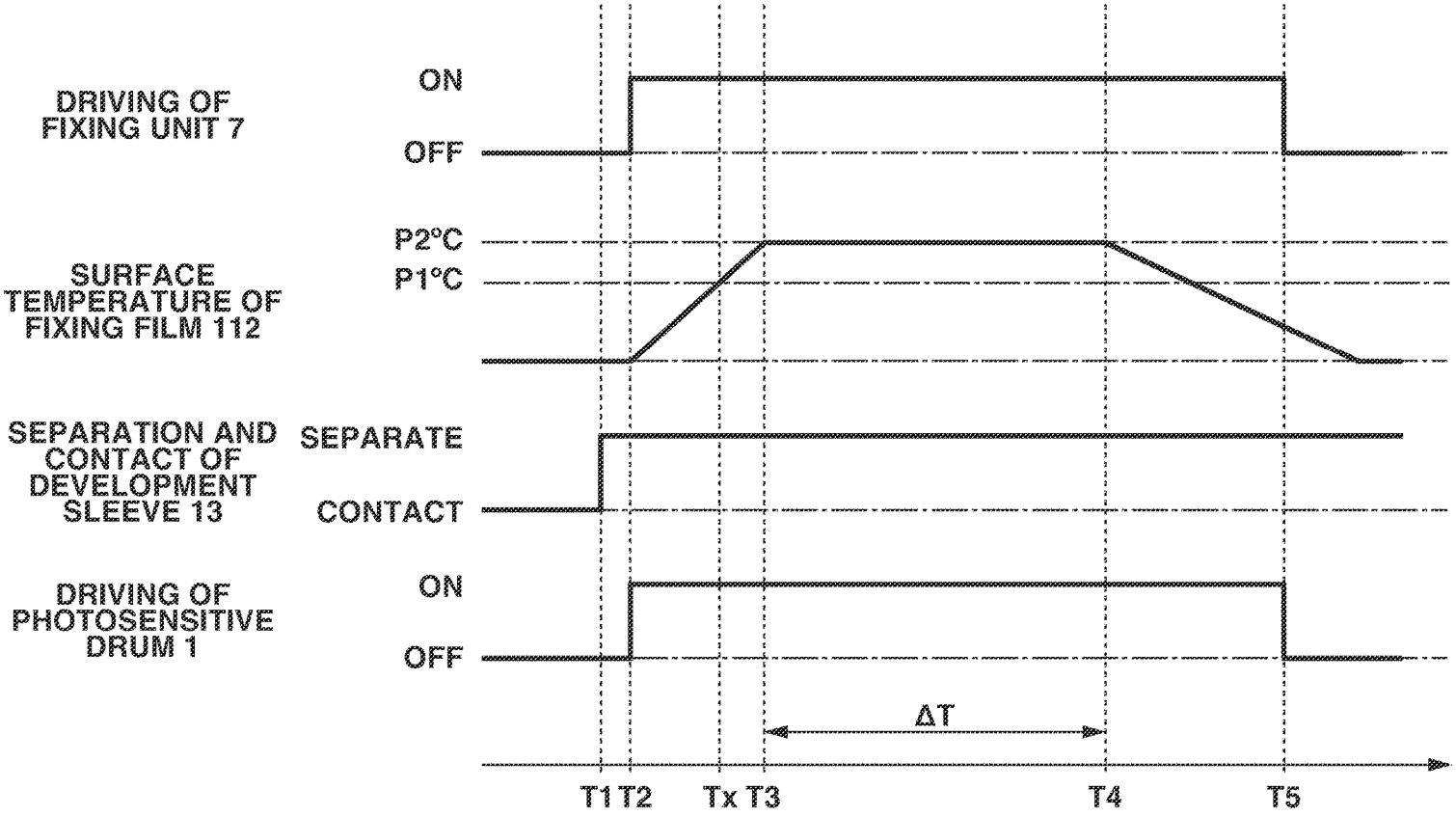
FIG. 7 is a timing chart illustrating a condensation removal sequence.

Next, a condensation removal sequence (condensation removal mode) of removing condensation on the surface of the photosensitive drum 1 will be described below with reference to FIG. 7, which is a timing chart illustrating the condensation removal sequence. The condensation removal sequence is executed while the control unit 33 controls the related units, members, etc. as described below. First, at a timing T1, the pressing member 70 is operated to switch the development sleeve 13 and the photosensitive drum 1 to the separated state. If the development sleeve 13 and the photosensitive drum 1 are already in the separated state at the timing T1 at which the condensation removal sequence is started, the control unit 33 performs control to maintain the separated state. Next, at a timing T2, the driving of the photosensitive drum 1 is turned on to rotate the photosensitive drum 1, and the driving of the fixing unit 7 is turned on to rotate the pressing roller 110. Simultaneously, the heater 113 is operated (caused to generate heat). The heater 113 is controlled based on the output of the thermistor 115 such that the temperature P of the portion DP1 (FIG. 4) of the surface of the fixing film 112 immediately after the fixing film 112 passes through the fixing nip area N is P2 [degrees Celsius] (P2>P1) which is higher than the temperature P during the fixing of the toner image to the sheet S. P2>P1 is satisfied under the condition that P1 and P2 are measured under the same outside temperature of the image forming apparatus 100. According to the present exemplary embodiment, P2 [degrees Celsius]=180 [degrees Celsius]. The temperature of the ambient atmosphere of the thermistor 115, the heater 113, or the pressing stay 114 at the time when the temperature P of the portion DP1 (FIG. 4) immediately after the fixing film 112 passes through the fixing nip area N is P2 is denoted by P8 [degrees Celsius], and the temperature P8 [degrees Celsius] is higher than the temperature P7 [degrees Celsius] (P8>P7). From a timing T3 at which the temperature P reaches P2 [degrees Celsius] or higher, the photosensitive drum 1 is rotated continuously for a predetermined period of time ΔT while the temperature P is maintained at P2 [degrees Celsius] or higher. In this way, the inside of the image forming apparatus 100 and the entire surface of the photosensitive drum 1 are heated by the heat emitted from the fixing unit to evaporate moisture of condensation adhering to the photosensitive drum 1 so that the condensation is removed from the surface of the photosensitive drum 1. The predetermined period of time ΔT is set equal to or longer than a period of time needed to evaporate moisture of condensation adhering to the photosensitive drum 1.

At a timing T4 at which the predetermined period of time ΔT elapses from the timing T3, an operation to end the condensation removal sequence is started. Specifically, the operation (heat generation) of the heater 113 is stopped. Consequently, the temperature P gradually decreases. Further, at a timing T5 at which the temperature P is decreased to a predetermined level, the driving of the fixing unit 7 and the driving of the photosensitive drum 1 are turned off to complete the condensation removal sequence.

As described above, the condensation removal sequence is the rotation control performed such that the photosensitive drum 1 is rotated with the temperature of the fixing unit 7 maintained higher than the temperature of the fixing unit 7 during the fixing to the sheet S in the image forming process, in order to remove condensation. While the temperature of the portion of the surface of the fixing film 112 immediately after the fixing film 112 passes through the fixing nip area N is described as the temperature of the fixing unit 7, the temperature of the fixing unit 7 is not limited to the temperature of the portion. Alternatively, for example, the temperature of the fixing unit 7 can be the temperature of a portion of the surface of a heated rotary member of the fixing unit 7, such as the fixing film 112 or the pressing roller 110, that is in contact with the air, i.e., the temperature of a portion of the surface of the fixing film 112 or the surface of the pressing roller 110 other than the fixing nip area N. Alternatively, the temperature of the fixing unit 7 can be the temperature of the surface of the fixing frame 7*a* or the temperature of the surface of a portion DP2 (refer to the fixing unit 7 in FIG. 2) of the surface of the fixing frame 7*a*, which is the closest portion to the photosensitive drum 1. Further, while the development sleeve 13 and the photosensitive drum 1 are switched to the separated state at the timing T1, the timing to switch the development sleeve 13 and the photosensitive drum 1 to the separated state is not limited to the timing T1. Alternatively, the timing to switch the development sleeve 13 and the photosensitive drum 1 to the separated state can be set to a timing after the timing T2 and before a timing Tx at which the temperature of the surface of the fixing film 112 reaches P1 [degrees Celsius].

In the case of performing the image forming process immediately after the condensation removal sequence, an operation to prepare for the image forming process is started at the timing T4 without performing the operation to end the condensation removal sequence.

Modified Examples of Condensation Removal Sequence

Figure 8:
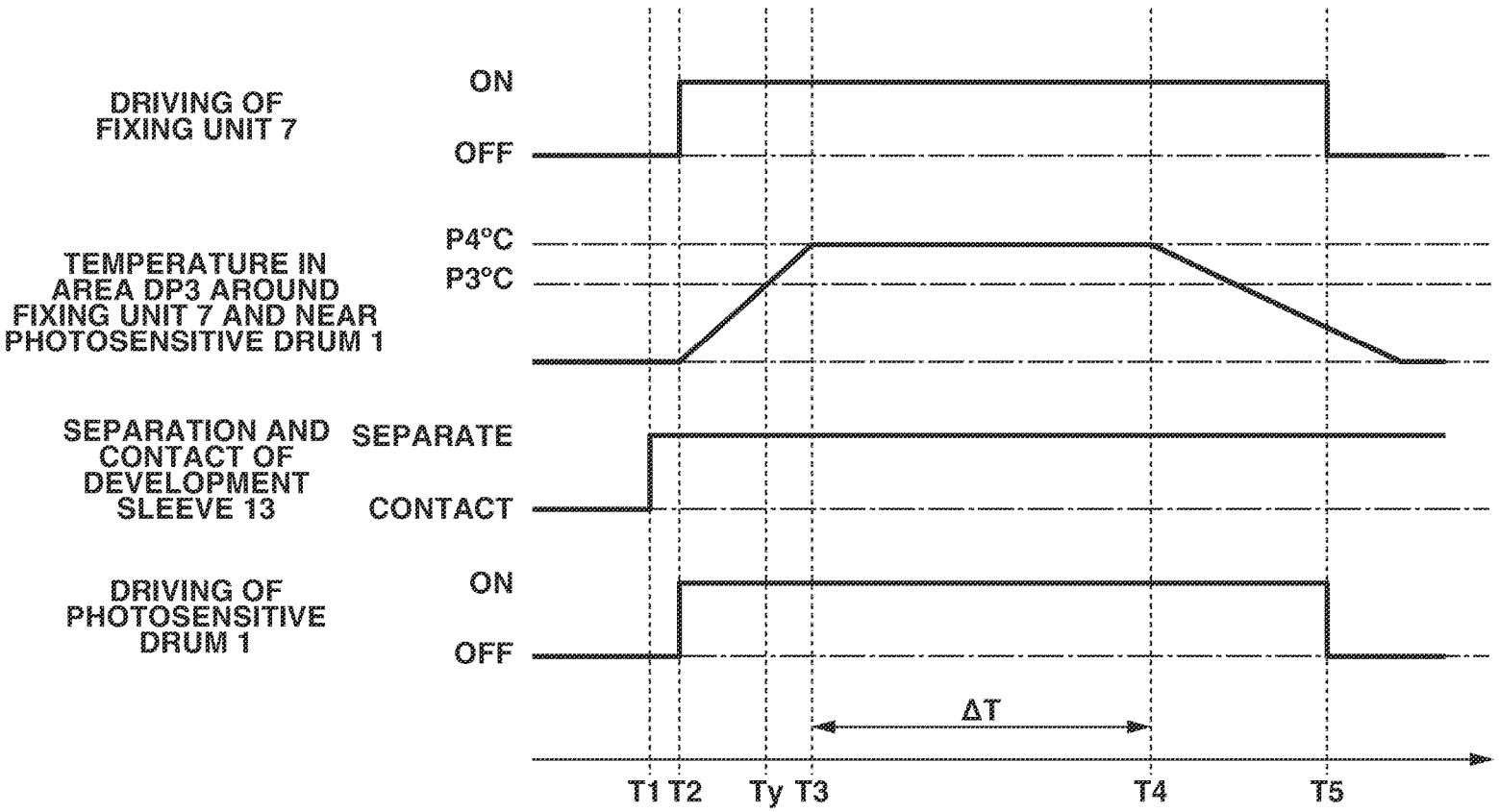
FIG. 8 is a timing chart illustrating a condensation removal sequence according to a first modified example.

Next, modified examples of the condensation removal sequence will be described below. While the temperature of the fixing unit 7 is used as one condition in the condensation removal sequence described above, the temperature of the air (ambient temperature) in a portion DP3 (refer to FIG. 2) around the fixing unit 7 and close to the photosensitive drum 1 in the apparatus body 100A is used as a condition according to a first modified example. As illustrated in FIG. 2, the portion DP3 can also be described as a portion in a space around the fixing unit 7 in the apparatus body 100A that is located between the fixing unit 7 and the drum unit 10A. FIG. 8 is a timing chart illustrating the condensation removal sequence according to the first modified example. The temperature of the portion DP3 during the fixing to the sheet S in the image forming process is P3 [degrees Celsius]. In the condensation removal sequence according to the first modified example, as illustrated in FIG. 8, the photosensitive drum 1 is continuously rotated for the predetermined period of time ΔT in the separated state with the temperature of the portion DP3 maintained at a temperature P4 [degrees Celsius] which is higher than the temperature P3 [degrees Celsius] (P4>P3). This rotation control is the condensation removal sequence according to the first modified example. P4>P3 is satisfied under the condition that P4 and P3 are measured under the same outside temperature of the image forming apparatus 100. According to the first modified example, the timing to switch the development sleeve 13 and the photosensitive drum 1 to the separated state can be a timing after the timing T2 and before a timing Ty at which the temperature of the portion DP3 reaches P3 [degrees Celsius], as in the first exemplary embodiment.

Figure 9:
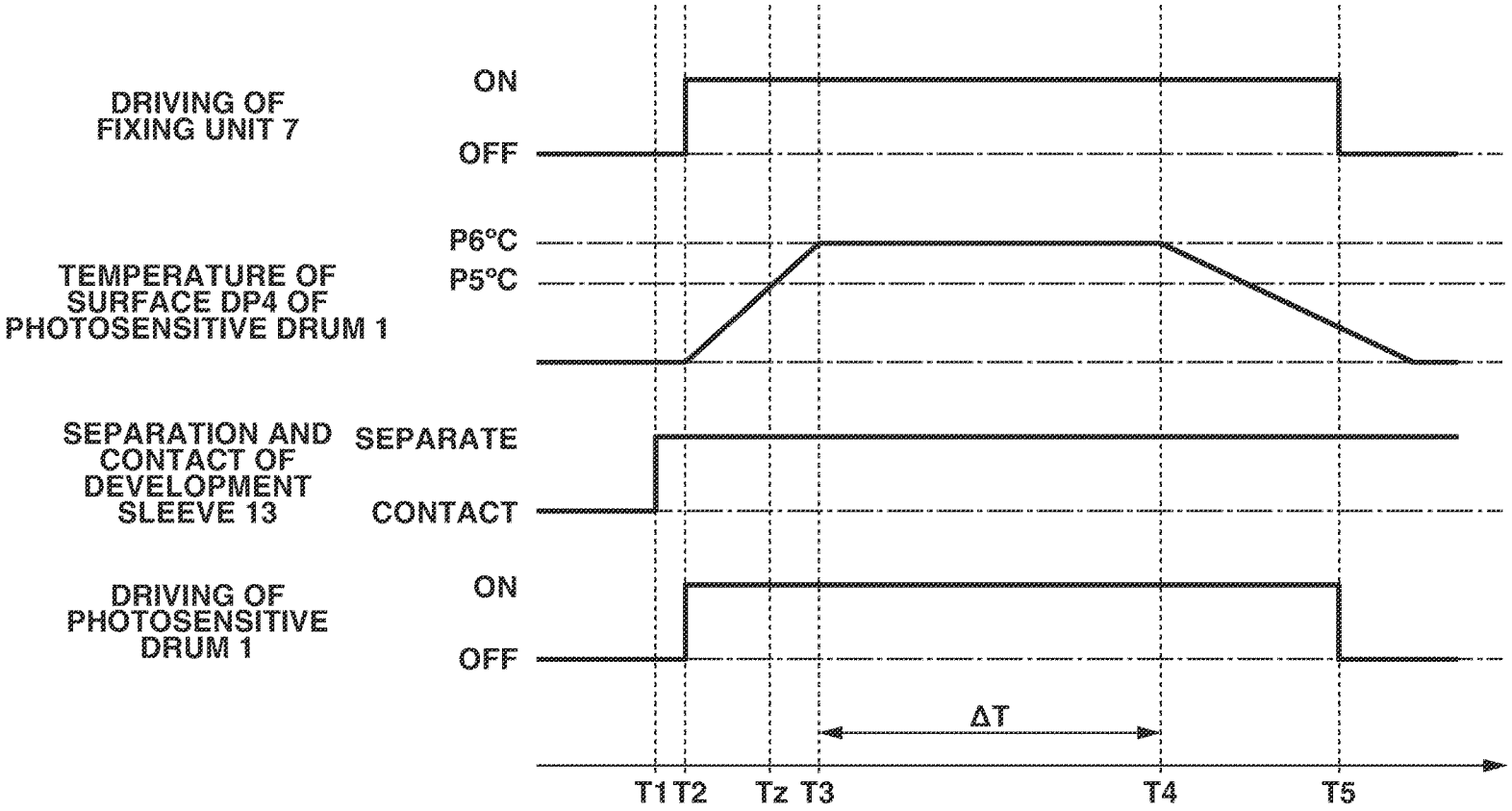
FIG. 9 is a timing chart illustrating a condensation removal sequence according to a second modified example.

According to a second modified example, while the temperature of the fixing unit 7 is used as one condition in the condensation removal sequence described above, the temperature of a surface DP4 (refer to FIG. 2) of the photosensitive drum 1 is used as a condition. FIG. 9 is a timing chart illustrating the condensation removal sequence according to the second modified example. The temperature of the surface DP4 of the photosensitive drum 1 during the fixing to the sheet S in the image forming process is P5 [degrees Celsius]. In the condensation removal sequence according to the second modified example, as illustrated in FIG. 9, the photosensitive drum 1 is continuously rotated for the predetermined period of time ΔT in the separated state with the temperature of the surface DP4 of the photosensitive drum 1 maintained at a temperature P6 [degrees Celsius] which is higher than the temperature P5 [degrees Celsius] (P6>P5). P6>P5 is satisfied under the condition that P6 and P5 are measured under the same outside temperature of the image forming apparatus 100. This rotation control is the condensation removal sequence according to the second modified example. According to the second modified example, the timing to switch the development sleeve 13 and the photosensitive drum 1 to the separated state can be a timing after the timing T2 and before a timing Tz at which the temperature of the surface DP4 of the photosensitive drum 1 reaches P5 [degrees Celsius], as in the first exemplary embodiment.

<Conditions for Execution of Condensation Removal Sequence>

Conditions for execution of the condensation removal sequence and a modified example thereof will be described below with reference to a flow chart illustrated in FIG. 5. The process illustrated in the flow chart is executed by the control unit 33.

In step S1, whether the image forming process is currently performed is determined. This determination is performed to determine whether the current period is the period of time during which the fixing to the sheet S is not performed. Next, in step S2, whether the elapsed time from the time when the image forming apparatus 100 is turned on is a time t6 or shorter is determined. This determination is performed to determine whether the current time is a time point immediately after the image forming apparatus 100 is turned on. If it is determined that the elapsed time is the time t6 or shorter (YES in step S2), then in step S3, whether the absolute moisture content is not lower than a predetermined threshold value is determined. The apparatus body 100A includes a temperature/humidity sensor (humidity detection unit) 101 which detects the temperature and humidity in (inside) the image forming apparatus 100, and based on the output from the temperature/humidity sensor 101, the control unit 33 calculates the absolute moisture content of the inside. The predetermined threshold value of the absolute moisture content is set to a value for determining whether the temperature and humidity are high. According to the present exemplary embodiment, the predetermined threshold value of the absolute moisture content is set to 20 g/m$^3$. If it is determined that the absolute moisture content is not lower than the predetermined threshold value (YES in step S3), then in step S4, the above-described condensation removal sequence is executed, and the process is ended. On the other hand, if it is determined that the absolute moisture content is lower than a predetermined threshold value (NO in step S3), the process is ended without executing the above-described condensation removal sequence.

Further, in step S1, if it is determined that the image forming process is currently not performed (NO in step S1), then in step S5, whether a time t7 or longer passes without execution of the condensation removal sequence from the end of the previous image forming process is determined. This determination is performed to determine whether a predetermined time passes without execution of the condensation removal sequence from the end of the previous image forming process. If it is determined that the time t7 or longer passes without execution of the condensation removal sequence from the end of the previous image forming process (YES in step S5), the processing proceeds to step S3. On the other hand, if it is determined that the time t7 or longer does not pass without execution of the condensation removal sequence from the end of the previous image forming process (NO in step S5), then in step S6, whether a time t8 or longer passes without execution of the image forming process from the end of the previous condensation removal sequence is determined. This determination is performed to determine whether a predetermined time passes without execution of the image forming process from the end of the previous condensation removal sequence. If it is determined that the time t8 or longer passes without execution of the image forming process from the end of the previous condensation removal sequence (YES in step S6), the processing proceeds to step S3. On the other hand, if it is determined that the time t8 or longer does not pass without execution of the image forming process from the end of the previous condensation removal sequence (NO in step S6), the process is ended without execution of the above-described condensation removal sequence.

The above-described process enables execution of the condensation removal sequence when a high-temperature, high-humidity environmental condition is satisfied immediately after the image forming apparatus 100 is turned on or after the predetermined time passes without execution of the image forming process and the condensation removal sequence.

Figure 5:
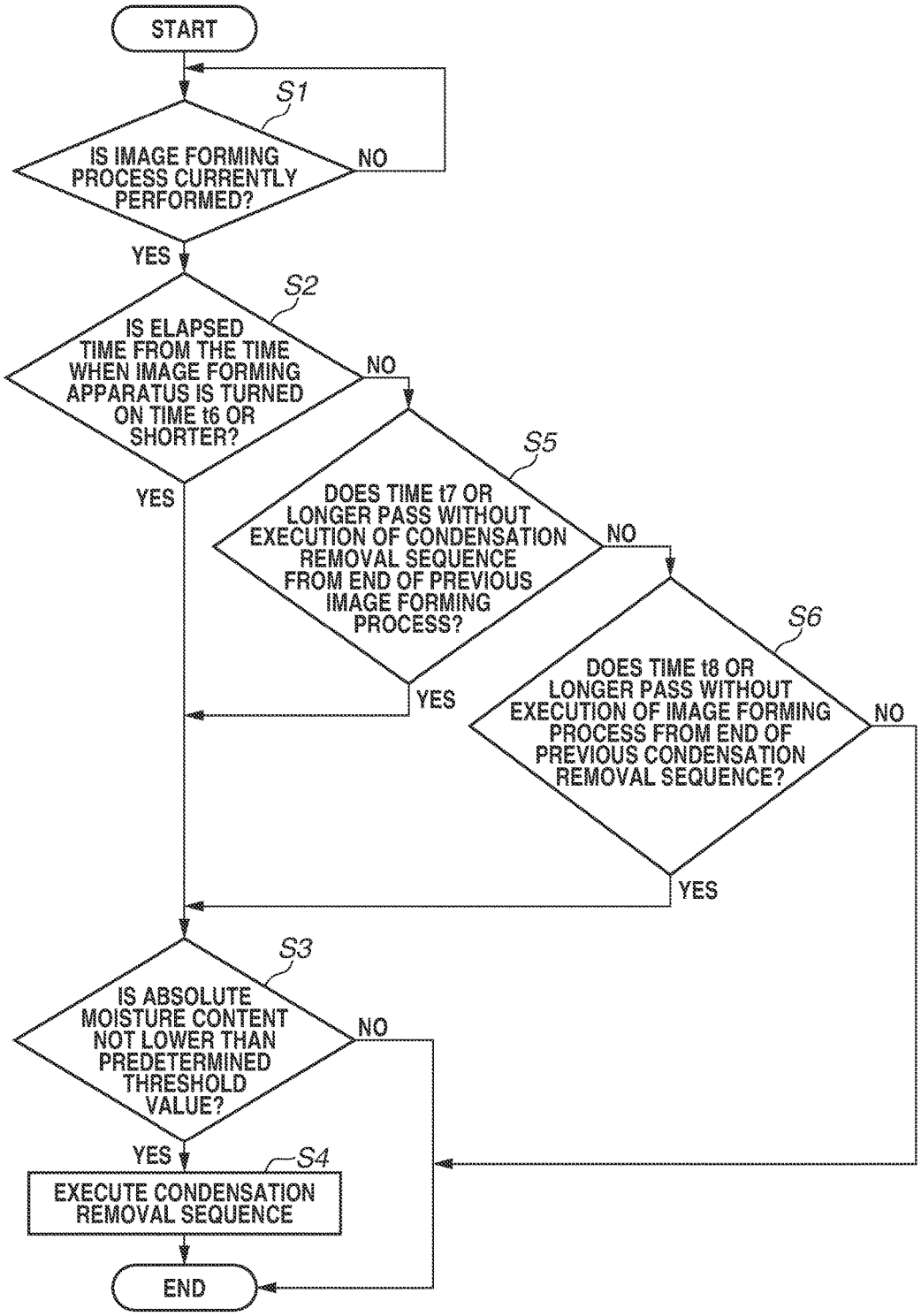
FIG. 5 is a flow chart illustrating conditions for execution of a condensation removal sequence.

Alternatively, the condensation removal sequence may be executable in response to an instruction from a user independently of the flow chart illustrated in FIG. 5.

Comparison to First Comparative Example

Next, advantageous effects of the present exemplary embodiment and the first comparative example in which the condensation removal sequence is performed with the development sleeve 13 and the photosensitive drum 1 being in the contact state are compared. The first comparative example is similar to the first exemplary embodiment and a similar condensation removal sequence is executed, except that the development sleeve 13 and the photosensitive drum 1 are in the contact state. In the condensation removal sequence, the control is performed such that the development sleeve 13 is rotated while the photosensitive drum 1 is rotated.

Table 1 shows the results of evaluation of image smearing, fog, and drum scratches in the cases of different lengths of the predetermined period of time ΔT in the condensation removal sequence according to the first exemplary embodiment and the first comparative example. In every one of the cases, the condensation removal sequence was performed using the cartridge 10 that had been left overnight after execution of printing of about 1000 sheets under a high-temperature, high-humidity environment (temperature 32 degrees Celsius, humidity 80%). In Table 1, Nos. 1 and 2 are the two results of evaluation of the cases of different lengths of the predetermined time ΔT according to the first exemplary embodiment, and Nos. 3 to 6 are the results of evaluation of the cases of different lengths of the predetermined time ΔT according to the first comparative example.

As to the evaluation of image smearing, "good" indicates that no image smearing occurred, "average" indicates that minor image smearing occurred, and "poor" indicates that significant character omission occurred. As to the fog and drum scratches, evaluations were performed only with respect to Nos. 2, 5, and 6 which had an advantageous effect on image smearing. Specifically, the condensation removal sequence was executed each time the image forming process on 50 sheets was executed, and after the image forming process on 6000 sheets was completed, evaluations were performed. In Table 1, "good" indicates that no problem occurred, "average" indicates that a problem that the image was slightly affected occurred, and "poor" indicates that a problem that the image was significantly affected occurred.

TABLE 1

| No. | Exemplary Embodiment/ Comparative Example | Predetermined Time ΔT | Image Smearing | Fog | Drum Scratch |
|---|---|---|---|---|---|
| 1 | First Exemplary Embodiment | 10 sec. | Average | — | — |
| 2 | First Exemplary Embodiment | 20 sec. | Good | Good | Good |

TABLE 1-continued

| No. | Exemplary Embodiment/ Comparative Example | Predetermined Time ΔT | Image Smearing | Fog | Drum Scratch |
|---|---|---|---|---|---|
| 3 | First Comparative Example | 10 sec. | Poor | — | — |
| 4 | First Comparative Example | 20 sec. | Poor | Average | Good |
| 5 | First Comparative Example | 30 sec. | Average | Poor | Poor |
| 6 | First Comparative Example | 40 sec. | Good | — | — |

As apparent from the above-described results, it is confirmed that the first exemplary embodiment has a more advantageous effect on image smearing than the first comparative example because in the first exemplary embodiment, the development sleeve 13 and the photosensitive drum 1 are separated and, thus, the temperature of the surface of the photosensitive drum 1 is easily increased and an advantageous effect on image smearing is produced even if the predetermined time ΔT is short. In the first comparative example, the predetermined time ΔT needs to be set long in order to avoid a problem of image smearing, so vertical streaks are more likely to be produced due to scratches on the surface of the photosensitive drum 1. Further, the toner is damaged and deteriorated by the heat from the photosensitive drum 1 or increased rubbing stress to produce fog. In the cases of the same setting of the predetermined time ΔT, the fog in the first comparative example is worse than the fog in the first exemplary embodiment.

As described above, in the case of heating the photosensitive drum 1 in the contact state as in the first comparative example, the heat is transmitted from the photosensitive drum 1 to the development sleeve 13, so it takes a longer time to increase the temperature of the surface of the photosensitive drum 1. Thus, the time (downtime) during which the image forming process cannot be performed may need to be set long. On the other hand, in the condensation removal sequence according to the present exemplary embodiment, the photosensitive drum 1 is heated in the separated state, so the downtime for executing the condensation removal sequence can be set short.

Further, in the case of heating the photosensitive drum 1 in the contact state as in the first comparative example, the photosensitive drum 1 needs to be rotated for a longer time during the heating of the photosensitive drum 1, and this can accelerate abrasion and deterioration of the surface of the photosensitive drum 1 as a result of being rubbed against the members that are in contact with the photosensitive drum 1. Similarly, the surface of the development sleeve 13 can also be abraded to accelerate deterioration. On the other hand, in the condensation removal sequence according to the present exemplary embodiment, the photosensitive drum 1 is heated in the separated state, so the photosensitive drum 1 and the development sleeve 13 are prevented from deteriorating.

Further, as illustrated in FIG. 2, in the separated state, a rotation shaft 1*a* of the photosensitive drum 1 is located closer to the fixing unit 7 than a rotation shaft 13*a* of the development sleeve 13. Further, the rotation shaft 13*a* of the development sleeve 13 is located farther from the fixing unit 7 in the separated state than in the contact state illustrated in FIG. 1. Thus, the heat from the fixing unit 7 is less likely to be transmitted to the development sleeve 13 in the separated state than in the contact state. Further, in the separated state, the rotation shaft 1*a* of the photosensitive drum 1 located below the fixing unit 7 in the vertical direction, and the rotation shaft 13*a* of the development sleeve 13 is located further below the rotation shaft 1*a* in the vertical direction. Due to the positional relationship, heat energy emitted from the fixing unit 7 is more likely to reach the surface of the photosensitive drum 1 than the development unit 10B. This prevents damage to the toner stored in the development unit 10B and prevents accelerated deterioration.

According to the present exemplary embodiment, condensation is removed to prevent image defects such as image smearing and the like while an increase in downtime and deterioration in the image bearing member and the developer bearing member or the developer are prevented.

Figure 6:
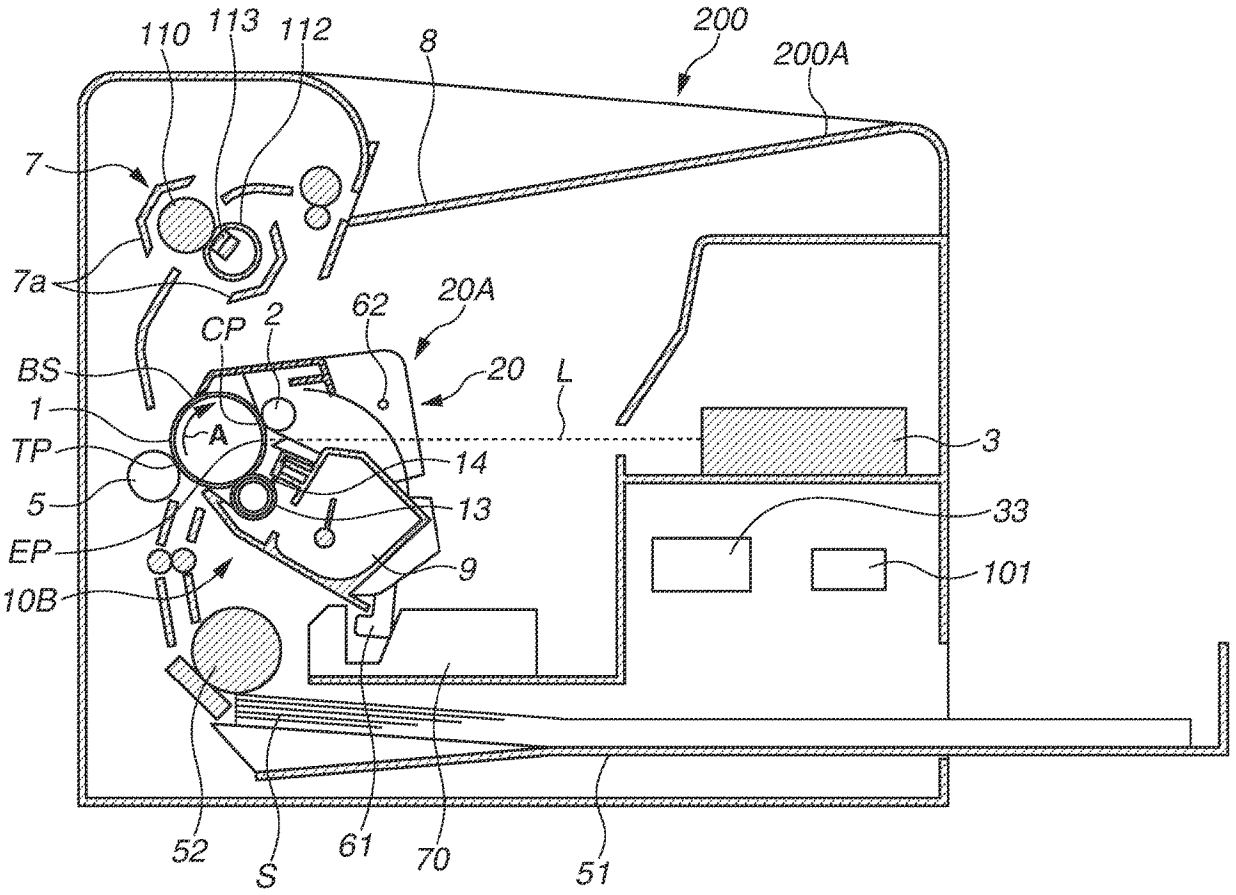
FIG. 6 is a cross-sectional view schematically illustrating an image forming apparatus.

Next, a second exemplary embodiment will be described below with reference to FIG. 6, which is a cross-sectional view schematically illustrating an image forming apparatus 200. The image forming apparatus 200 according to the present exemplary embodiment is different from that of the first exemplary embodiment in that a drum unit 20A of a cartridge 20 does not include a unit corresponding to the cleaning unit 6 according to the first exemplary embodiment. The cartridge 20 is attached to an apparatus body 200A. The image forming apparatus 200 employs a cleanerless system and, thus, does not include a unit corresponding to the cleaning unit 6 according to the first exemplary embodiment.

<Cleanerless System>

Next, the cleanerless system will be described in detail with reference to FIG. 6. The surface of the photosensitive drum 1 does not come into contact with any of the members (e.g., cleaning blade 6*a* in FIG. 1, etc.) after the surface passes through the transfer position TP and before the surface reaches the charging position CP, because a space BS is formed next to the surface of the photosensitive drum 1 along the surface of the photosensitive drum 1 between the transfer position TP and the charging position CP. Thus, the residual toner (untransferred residual toner) remaining on the surface of the photosensitive drum 1 after passing through the transfer position TP is moved to the charging position CP by the rotation of the photosensitive drum 1 without coming into contact with any of the members. Then, the toner is charged to have negative polarity by a discharge between the charging roller 2 and the photosensitive drum 1 in the charging position CP as the photosensitive drum 1 is charged to have negative polarity. At this time, the surface of the photosensitive drum 1 is charged to −700 V. The untransferred residual toner charged to have negative polarity passes through the charging area without adhering to the charging roller 2 due to the potential difference relationship (surface potential of photosensitive drum 1=−700 V, charging roller potential=−1300 V). The untransferred residual toner having passed through the charging position CP reaches an exposure position EP on the surface of the photosensitive drum 1 which is irradiated with the laser light L from the laser scanner 3. The amount of untransferred residual toner is not large enough to block the laser light L from the laser scanner 3, so an electrostatic latent image is formed as appropriate on the photosensitive drum 1. The toner that has passed through the exposure position EP and is on an unexposed area (region that is not irradiated with the laser light L) of the surface of the photosensitive drum 1 is collected by the development sleeve 13 due to the electrostatic force in the position in which the surface of the photosensitive drum 1 comes into contact with the development sleeve 13. The toner collected by the development sleeve 13 is collected by the storage area 9 due to the rotation of the development sleeve 13.

On the other hand, the toner that has passed through the exposure position EP and is in an exposed area (region that is irradiated with the laser light L) of the surface of the photosensitive drum 1 is not electrostatically collected and continues to remain on the photosensitive drum 1. Some of the toner on the exposed area can be scraped and collected by the development sleeve with the physical force due to a difference in peripheral speed between the development sleeve 13 and the photosensitive drum 1. Such toner is also collected by the storage area 9 via the development sleeve 13.

Most of the untransferred toner remaining on the photosensitive drum 1 is collected by the storage area 9 except for the toner on the exposed area. Then, the toner collected by the storage area 9 is mixed with the toner already stored in the storage area 9 and is reused.

As described above, the development unit 10B applies the toner to the exposed area while collecting the toner remaining on the photosensitive drum 1.

In the case of employing the cleanerless system described above, it is difficult to remove discharge products generated during the charging by the charging roller 2*a*, additives contained in sheets, etc. from the surface of the photosensitive drum 1, compared to the arrangement according to the first exemplary embodiment in which the cleaning blade 6*a* is included. The discharge products, additives, etc. are likely to absorb moisture, and this increases the possibility of occurrence of image smearing. Thus, according to the present exemplary embodiment, the predetermined time ΔT of the condensation removal sequence is set longer than the predetermined time ΔT according to the first exemplary embodiment. In this way, condensation is removed to prevent image defects such as image smearing and the like while an increase in downtime and deterioration in the image bearing member and the developer bearing member or the developer are prevented even in the image forming apparatus that employs the cleanerless system. As a modified example of the condensation removal sequence according to the present exemplary embodiment, a modified example in which the condition of the temperature of the fixing unit 7 is changed as in the first and second modified examples of the first exemplary embodiment is applicable.

Comparison to Second Comparative Example

Next, advantageous effects of the present exemplary embodiment and the second comparative example in which the cleanerless system is employed and the condensation removal sequence is performed with the development sleeve 13 and the photosensitive drum 1 being in the contact state are compared. The second comparative example is similar to the second exemplary embodiment and a similar condensation removal sequence is executed, except that the development sleeve 13 and the photosensitive drum 1 are in the contact state. In the condensation removal sequence, the control is performed such that the development sleeve 13 is rotated while the photosensitive drum 1 is rotated.

Table 2 shows the results of evaluation of image smearing, fog, and drum scratches in the cases of different lengths of the predetermined period of time ΔT in the condensation removal sequence according to the second exemplary embodiment and the second comparative example. In every one of the cases, the condensation removal sequence was performed using the cartridge 10 that had been left overnight after execution of printing of about 1000 sheets under a high-temperature, high-humidity environment (temperature 32 degrees Celsius, humidity 80%). In Table 2, Nos. 1 and 2 are the two results of evaluation of the cases of different lengths of the predetermined time ΔT according to the second exemplary embodiment, and Nos. 3 and 4 are the two results of evaluation of the cases of different lengths of the predetermined time ΔT according to the second comparative example. As to the fog and drum scratches, evaluations were performed only with respect to Nos. 2 and 4 which had an advantageous effect on image smearing. The experiment conditions are the same as those in Table 1. Further, evaluation criteria with respect to image smearing, fog, and drum scratches are the same as those in Table 1.

TABLE 2

| No. | Exemplary Embodiment/ Comparative Example | Predetermined Time ΔT | Image Smearing | Fog | Drum Scratch |
|---|---|---|---|---|---|
| 1 | Second Exemplary Embodiment | 15 sec. | Poor | — | — |
| 2 | Second Exemplary Embodiment | 30 sec. | Good | Good | Good |
| 3 | Second Comparative Example | 45 sec. | Poor | — | — |
| 4 | Second Comparative Example | 60 sec. | Average | Poor | Good |

As apparent from the above-described results, it is confirmed that the second exemplary embodiment has a more advantageous effect on image smearing than the second comparative example because in the second exemplary embodiment, the development sleeve 13 and the photosensitive drum 1 are separated and, thus, the temperature of the surface of the photosensitive drum 1 is easily increased and an advantageous effect on image smearing is produced even if the predetermined time ΔT is short. In the second comparative example, the predetermined time ΔT needs to be set long in order to avoid a problem of image smearing, so vertical streaks are more likely to be produced due to scratches on the surface of the photosensitive drum 1. Further, the toner is damaged and deteriorated by the heat from the photosensitive drum 1 or increased rubbing stress to produce fog. In the cases of the same setting of the predetermined time ΔT, the fog in the second comparative example is worse than the fog in the second exemplary embodiment.

According to the present exemplary embodiment, condensation is removed to prevent image defects such as image smearing and the like while an increase in downtime and deterioration in the image bearing member and the developer bearing member or the developer are prevented even in the case of employing the cleanerless system.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of priority from Japanese Patent Application No. 2016-191195, filed Sep. 29, 2016, which is hereby incorporated by reference herein in its entirety.

What is claimed is:

1. An image forming apparatus comprising:

an image bearing member configured to be rotatable and bear a developer image;

a developer bearing member configured to be rotatable, bear a developer, and supply the developer to a surface of the image bearing member to form the developer image;

a switching unit configured to move the developer bearing member between a contact position in which the developer bearing member is in contact with the image bearing member, and a separated position in which the developer bearing member is separated from the image bearing member; and a fixing unit including a heating member, a rotary member which is heated by the heating member, and a nip area where the rotary member comes into contact with a sheet, and configured to perform fixing by heating the developer image transferred to the sheet and fixing the developer image to the sheet in the nip area, wherein when the developer bearing member is in the separated position, a rotation shaft of the image bearing member is located closer to the fixing unit than a rotation shaft of the developer bearing member, the image forming apparatus further comprising a control unit configured to execute, while the fixing is not performed, a mode in which the image bearing member is rotated, with (1) the developer bearing member being in the separated position and (2) the heating member being controlled such that a temperature of a portion of a surface of the rotary member after the rotary member passes through the nip area is maintained higher than the temperature of the portion during the fixing.

2. The image forming apparatus according to claim 1, wherein while the mode is executed, there is a period of time during which a temperature of the surface of the image bearing member is higher than the temperature of the surface of the image bearing member during the fixing.

3. The image forming apparatus according to claim 1, wherein when the developer bearing member is placed in the separated position by the switching unit, the rotation shaft of the image bearing member is located below the fixing unit in a vertical direction and the rotation shaft of the developer bearing member is located below the rotation shaft of the image bearing member in the vertical direction.

4. The image forming apparatus according to claim 1, wherein the developer is a mono component developer, wherein when the image bearing member is in the contact position, the developer is supplied to the surface of the image bearing member, wherein the image bearing member is rotated so that the surface of the image bearing member passes through a charging position in which the surface of the image bearing member is charged by a charging member and a transfer position in which the developer image formed on the surface of the image bearing member is transferred onto a transfer receiving member by a transfer member, and wherein the developer adhering to the surface of the image bearing member after the surface of the image bearing member passes through the transfer position is collectable from the surface of the image bearing member by the developer bearing member.

5. The image forming apparatus according to claim 1, wherein the control unit performs the rotation control with the developer bearing member being stopped rotating.

6. An image forming apparatus comprising:

an image bearing member configured to be rotatable and bear a developer image;

a developer bearing member configured to be rotatable, bear a developer, and supply—the developer to a surface of the image bearing member to form the developer image;

a switching unit configured to move the developer bearing member between a contact position in which the developer bearing member is in contact with the image bearing member, and a separated position in which the developer bearing member is separated from the image bearing member; and a fixing unit including a heating member, a rotary member which is heated by the heating member, and a frame which supports the rotary member, and configured to perform fixing by heating the developer image transferred to a sheet and fixing the developer image to the sheet, wherein when the developer bearing member is in the separated position, a rotation shaft of the image bearing member is located closer to the fixing unit than a rotation shaft of the developer bearing member, the image forming apparatus further comprising a control unit configured to execute, while the fixing is not performed, a mode in which the image bearing member is rotated, with (1) the developer bearing member being in the separated position and (2) a temperature of a closest portion of a surface of the frame to the image bearing member being maintained higher than the temperature of the closest portion during the fixing.

7. The image forming apparatus according to claim 6, wherein while the mode is executed, there is a period of time during which a temperature of the surface of the image bearing member is higher than the temperature of the surface of the image bearing member during the fixing.

8. The image forming apparatus according to claim 6, wherein when the developer bearing member is placed in the separated position by the switching unit, the rotation shaft of the image bearing member is located below the fixing unit in a vertical direction and the rotation shaft of the developer bearing member is located below the rotation shaft of the image bearing member in the vertical direction.

9. The image forming apparatus according to claim 6, wherein the developer is a mono component developer, wherein when the image bearing member is in the contact position, the developer is supplied to the surface of the image bearing member, wherein the image bearing member is rotated so that the surface of the image bearing member passes through a charging position in which the surface of the image bearing member is charged by a charging member and a transfer position in which the developer image formed on the surface of the image bearing member is transferred onto a transfer receiving member by a transfer member, and wherein the developer adhering to the surface of the image bearing member after the surface of the image bearing member passes through the transfer position is collectable from the surface of the image bearing member by the developer bearing member.

10. The image forming apparatus according to claim 6, wherein the control unit performs the rotation control with the developer bearing member being stopped rotating.

11. An image forming apparatus comprising:

an image bearing member configured to be rotatable and bear a developer image;

a developer bearing member configured to be rotatable, bear a developer, and supply the developer to a surface of the image bearing member to form the developer image;

a switching unit configured to move the developer bearing member between a contact position in which the developer bearing member is in contact with the image bearing member, and a separated position in which the developer bearing member is separated from the image bearing member; and a fixing unit including a heating member, a rotary member which is heated by the heating member, and a frame which supports the rotary member, and configured to perform fixing to heat the developer image transferred to a sheet and fix the developer image to the sheet, wherein when the developer bearing member is in the separated position, a rotation shaft of the image bearing member is located closer to the fixing unit than a rotation shaft of the developer bearing member, the image forming apparatus further comprising a control unit configured to execute, while the fixing is not performed, a mode in which the image bearing member is rotated, with (1) the developer bearing member being in the separated position and (2) a temperature of air in a space between the fixing unit and the image bearing member being maintained higher than the temperature of the air between the fixing unit and the image bearing member during the fixing.

12. The image forming apparatus according to claim 11, wherein while the mode is executed, there is a period of time during which a temperature of the surface of the image bearing member is higher than the temperature of the surface of the image bearing member during the fixing.

13. The image forming apparatus according to claim 11, wherein when the developer bearing member is placed in the separated position by the switching unit, the rotation shaft of the image bearing member is located below the fixing unit in a vertical direction and the rotation shaft of the developer bearing member is located below the rotation shaft of the image bearing member in the vertical direction.

14. The image forming apparatus according to claim 11, wherein the developer is a mono component developer, wherein when the image bearing member is in the contact position, the developer is supplied to the surface of the image bearing member, wherein the image bearing member is rotated so that the surface of the image bearing member passes through a charging position in which the surface of the image bearing member is charged by a charging member and a transfer position in which the developer image formed on the surface of the image bearing member is transferred onto a transfer receiving member by a transfer member, and wherein the developer adhering to the surface of the image bearing member after the surface of the image bearing member passes through the transfer position is collectable from the surface of the image bearing member by the developer bearing member.

15. The image forming apparatus according to claim 11, wherein the control unit performs the rotation control with the developer bearing member being stopped rotating.

16. An image forming apparatus comprising:

an image bearing member configured to be rotatable and bear a developer image;

a developer bearing member configured to be rotatable, bear a developer, and supply the developer to a surface of the image bearing member to form the developer image;

a switching unit configured to move the developer bearing member between a contact position in which the developer bearing member is in contact with the image bearing member, and a separated position in which the developer bearing member is separated from the image bearing member; and a fixing unit including a heating member, a rotary member which is heated by the heating member, and a frame which supports the rotary member, and configured to perform fixing by heating the developer image transferred to a sheet and fixing the developer image to the sheet, wherein when the developer bearing member is in the separated position, a rotation shaft of the image bearing member is located closer to the fixing unit than a rotation shaft of the developer bearing member, the image forming apparatus further comprising a control unit configured to execute, while the fixing is not performed, a mode for evaporating moisture adhering to the surface of the image bearing member in which the image bearing member is rotated, with (1) the developer bearing member being in the separated position and (2) the rotary member being heated by the heating member.

17. The image forming apparatus according to claim 16, wherein while the mode is executed, there is a period of time during which a temperature of the surface of the image bearing member is higher than the temperature of the surface of the image bearing member during the fixing.

18. The image forming apparatus according to claim 16, wherein when the developer bearing member is placed in the separated position by the switching unit, the rotation shaft of the image bearing member is located below the fixing unit in a vertical direction and the rotation shaft of the developer bearing member is located below the rotation shaft of the image bearing member in the vertical direction.

19. The image forming apparatus according to claim 16, wherein the developer is a mono component developer, wherein when the image bearing member is in the contact position, the developer is supplied to the surface of the image bearing member, wherein the image bearing member is rotated so that the surface of the image bearing member passes through a charging position in which the surface of the image bearing member is charged by a charging member and a transfer position in which the developer image formed on the surface of the image bearing member is transferred onto a transfer receiving member by a transfer member, and wherein the developer adhering to the surface of the image bearing member after the surface of the image bearing member passes through the transfer position is collectable from the surface of the image bearing member by the developer bearing member.

20. The image forming apparatus according to claim 16, wherein the control unit performs the rotation control with the developer bearing member being stopped rotating.

21. An image forming apparatus comprising:

an image bearing member configured to be rotatable and bear a developer image;

a developer bearing member configured to be rotatable, bear a developer, and supply the developer to a surface of the image bearing member to form the developer image;

a switching unit configured to move the developer bearing member between a contact position in which the developer bearing member is in contact with the image bearing member, and a separated position in which the developer bearing member is separated from the image bearing member;

a fixing unit including a heating member, a rotary member which is heated by the heating member, and a frame which supports the rotary member, and configured to perform fixing by heating the developer image transferred to a sheet and fixing the developer image to the sheet; and a humidity detection unit, wherein when the developer bearing member is in the separated position, a rotation shaft of the image bearing member is located closer to the fixing unit than a rotation shaft of the developer bearing member, the image forming apparatus further comprising a control unit configured to execute, while the fixing is not performed, a mode in which the image bearing member is rotated, with (1) the developer bearing member being in the separated position and (2) the rotary member being heated by the heating member, wherein the control unit executes the mode based on output of the humidity detection unit.

22. The image forming apparatus according to claim 21, wherein the control unit calculates an absolute moisture content based on the output of the humidity detection unit, and if the calculated absolute moisture content is not lower than a predetermined threshold value, the control unit executes the mode, whereas if the calculated absolute moisture content is lower than the predetermined threshold value, the control unit does not execute the mode.

23. The image forming apparatus according to claim 21, wherein while the mode is executed, there is a period of time during which a temperature of the surface of the image bearing member is higher than the temperature of the surface of the image bearing member during the fixing.

24. The image forming apparatus according to claim 21, wherein when the developer bearing member is placed in the separated position by the switching unit, the rotation shaft of the image bearing member is located below the fixing unit in a vertical direction and the rotation shaft of the developer bearing member is located below the rotation shaft of the image bearing member in the vertical direction.

25. The image forming apparatus according to claim 21, wherein the developer is a mono component developer, wherein when the image bearing member is in the contact position, the developer is supplied to the surface of the image bearing member, wherein the image bearing member is rotated so that the surface of the image bearing member passes through a charging position in which the surface of the image bearing member is charged by a charging member and a transfer position in which the developer image formed on the surface of the image bearing member is transferred onto a transfer receiving member by a transfer member, and wherein the developer adhering to the surface of the image bearing member after the surface of the image bearing member passes through the transfer position is collectable from the surface of the image bearing member by the developer bearing member.

26. The image forming apparatus according to claim 21, wherein the control unit performs the rotation control with the developer bearing member being stopped rotating.

* * * * *